US011800268B1

(12) United States Patent
Prescott

(10) Patent No.: US 11,800,268 B1
(45) Date of Patent: Oct. 24, 2023

(54) FACE MASK WITH SPEAKER MODULE

(71) Applicant: Tyrone Prescott, Lehigh Acres, FL (US)

(72) Inventor: Tyrone Prescott, Lehigh Acres, FL (US)

( * ) Notice: Subject to any disclaimer, the term of this patent is extended or adjusted under 35 U.S.C. 154(b) by 175 days.

(21) Appl. No.: 17/560,629

(22) Filed: Dec. 23, 2021

(51) Int. Cl.

| | |
|---|---|
| ***H04R 1/02*** | (2006.01) |
| ***A62B 18/08*** | (2006.01) |
| ***A41D 13/11*** | (2006.01) |
| ***H04R 3/00*** | (2006.01) |
| ***F21V 33/00*** | (2006.01) |
| ***H04R 1/08*** | (2006.01) |
| ***F21Y 115/10*** | (2016.01) |
| ***A62B 23/02*** | (2006.01) |

(52) U.S. Cl.
CPC ..... *H04R 1/028* (2013.01); *A41D 13/11* (2013.01); *A62B 18/08* (2013.01); *A62B 18/084* (2013.01); *A62B 18/086* (2013.01); *F21V 33/0068* (2013.01); *H04R 1/08* (2013.01); *H04R 3/00* (2013.01); *A62B 23/025* (2013.01); *F21Y 2115/10* (2016.08); *H04R 2201/023* (2013.01)

(58) Field of Classification Search
CPC . H04R 1/028; H04R 1/08; H04R 3/00; A41D 13/11; A62B 18/08; A62B 18/084; A62B 18/086; F21V 33/0068
See application file for complete search history.

(56) References Cited

U.S. PATENT DOCUMENTS

| | | | | |
|---|---|---|---|---|
| 9,344,811 | B2 * | 5/2016 | Bakish | A41D 13/11 |
| 10,166,416 | B2 * | 1/2019 | Kihlberg | H04R 1/028 |
| 2015/0217143 | A1 * | 8/2015 | Palmer | A62B 9/04 29/592.1 |
| 2016/0008640 | A1 * | 1/2016 | Teetzel | A42B 3/228 128/201.19 |
| 2021/0298391 | A1 * | 9/2021 | Keene | A61L 9/20 |
| 2021/0393842 | A1 * | 12/2021 | Padilla | A62B 18/08 |
| 2022/0182749 | A1 * | 6/2022 | Reid | H04R 1/1083 |

* cited by examiner

*Primary Examiner* — Bryon T Gyllstrom
(74) *Attorney, Agent, or Firm* — SANCHELIMA & ASSOCIATES, P.A.; Christian Sanchelima; Jesus Sanchelima

(57) ABSTRACT

A face mask having speaker module with a pair of speakers, an aperture for a straw for liquid uptake, a tracking device, and illumination means. The interior side of the face mask includes a microphone that picks up the voice being transmitted by a user. The pair of speakers located on an exterior portion of the mask which will broadcast the user's voice received by the microphone. Additionally, the aperture along the front end in order to allows for easy access of a straw for drinking a beverage. The tracking device is fitted within the mask in order to locate it in the case that it is lost or stolen. Furthermore, the border of the mask is lined with LED lights which may be controlled by a software application on a mobile device.

10 Claims, 3 Drawing Sheets

FACE MASK WITH SPEAKER MODULE

BACKGROUND OF THE INVENTION

1. Field of the Invention.

The present invention relates to a face mask and, more particularly, to a face mask with a speaker module that includes a pair of speakers for amplifying a user's speaking voice when wearing the mask.

2. Description of the Related Art.

Several designs for a face mask have been designed in the past. None of them, however, include a face mask having speaker module with a pair of speakers, an aperture for a straw for liquid uptake, a tracking device, and illumination means. The interior side of the face mask includes a microphone that picks up the voice being transmitted by a user. The pair of speakers located on an exterior portion of the mask which will broadcast the user's voice received by the microphone. Additionally, the aperture along the front end in order to allows for easy access of a straw for drinking a beverage. The tracking device is fitted within the mask in order to locate it in the case that it is lost or stolen. Furthermore, the border of the mask is lined with LED lights which may be controlled by a software application on a mobile device. It is known that wearing a mask often dulls and muffles a wearers voice when speaking.

Therefore, there is a need for a face mask with a speaker module to address these issues.

Applicant believes that a related reference corresponds to U.S. Pat. No. 10,166,416 issued for a mask for filtering breathed air that includes an audio module that projects the speech of the wearer. Applicant believes that another related reference corresponds to U.S. Pat. No. 9,344,811 issued for a mask having a laser microphone device that is used to translate speech signals to a speaker. However, the cited references differ from the present invention because they fail to disclose a face mask having speaker module with a pair of speakers, an aperture for a straw for liquid uptake, a tracking device, and illumination means.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a face mask with speaker module that eliminates the dull and muffled speaking voice associated with wearing a mask.

It is another object of this invention to provide a face mask with speaker module that improves beverage intake for a wearer by providing an aperture to receive a straw for liquid intake.

It is still another object of the present invention to provide a face mask with speaker module that allows a user to easily locate their mask via a tracking device fitted on the mask.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
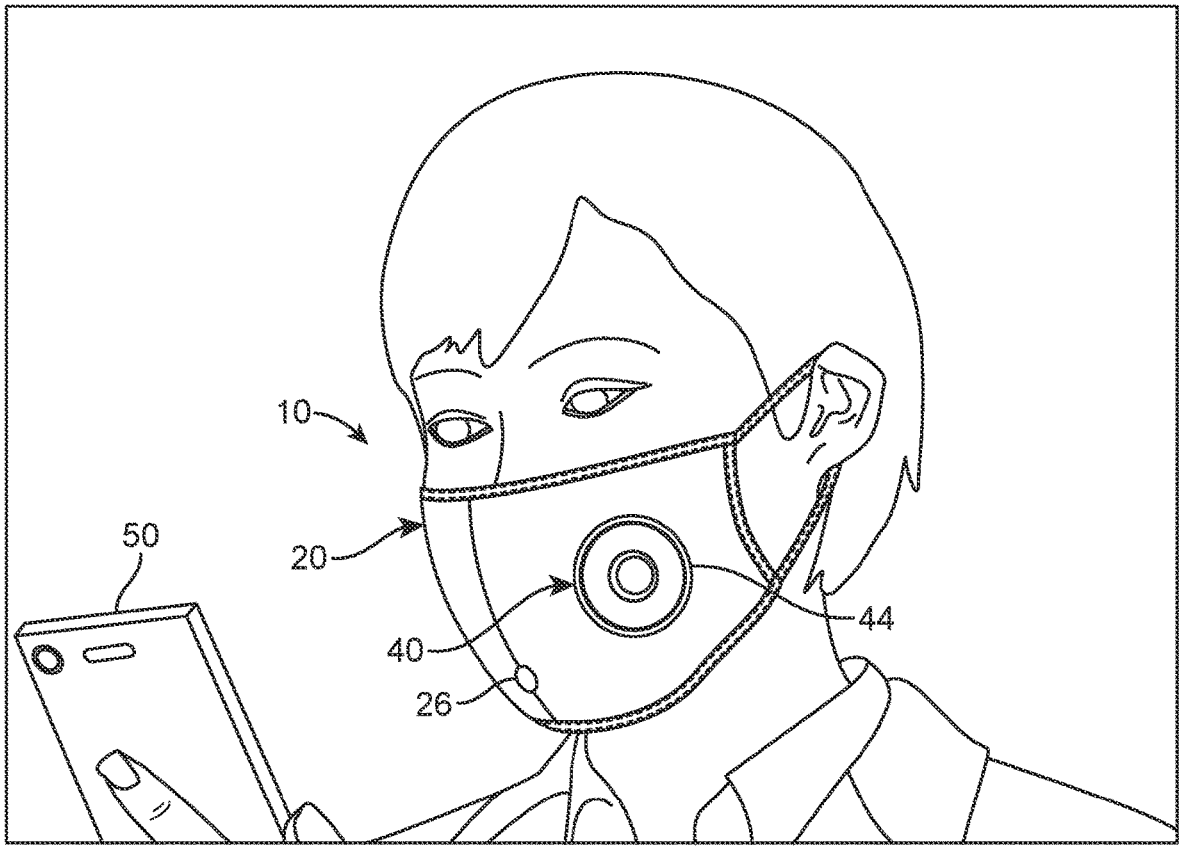
FIG. 1 represents an operational isometric view of face mask with speaker module 10 in accordance with an embodiment of the present embodiment.

Referring now to the drawings, where the present invention is generally referred to with numeral 10, it can be observed that it basically includes a mask assembly 20 and a speaker assembly 40.

Figure 2:
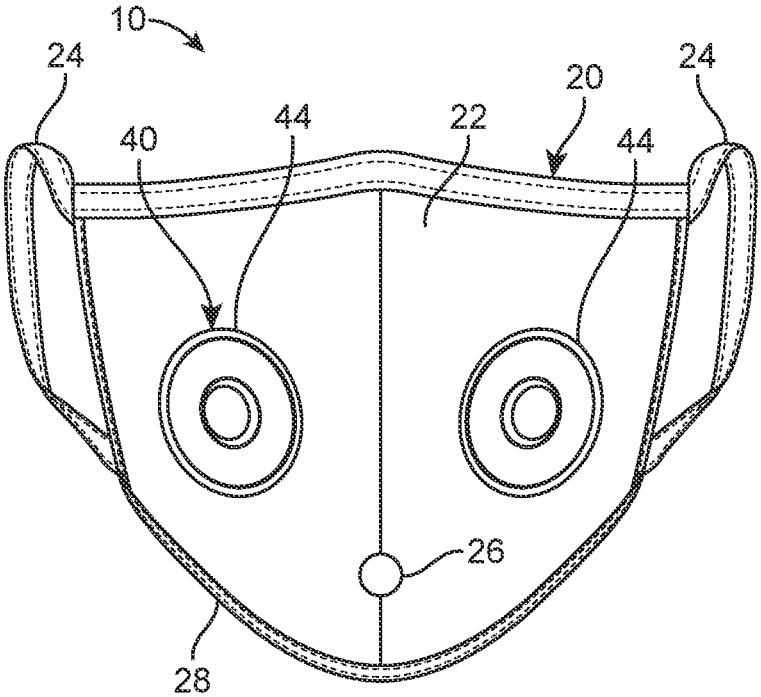
FIG. 2 shows a front view of face mask with speaker module 10 depicting speakers 44 of a speaker assembly 40 and illumination component 28 of a mask assembly 20 in accordance with an embodiment of the present invention.
Figure 3:
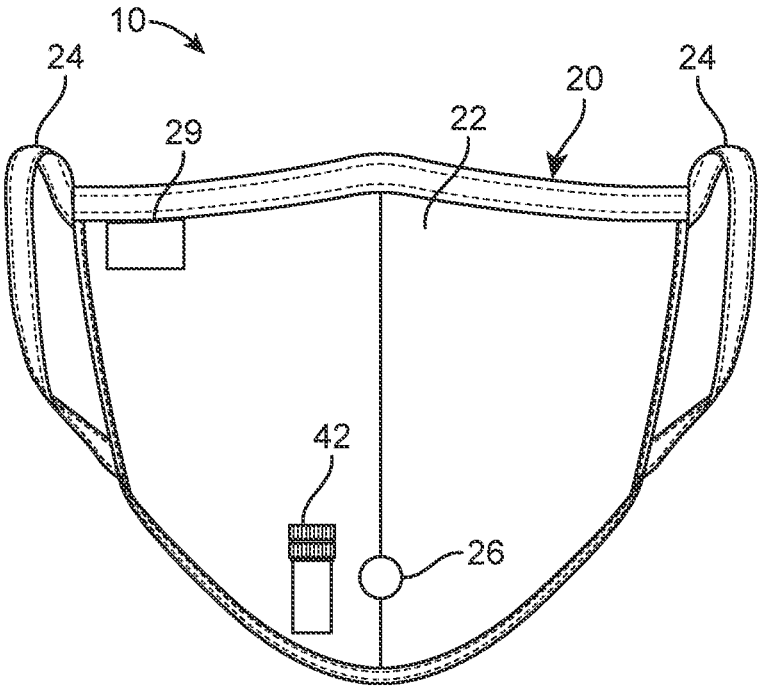
FIG. 3 illustrates a rear view of face mask with speaker module 10 depicting microphone 42 of speaker assembly 40 and tracking device 29 of speaker assembly 20 in accordance with an embodiment of the present invention.

Mask assembly 20 includes a cover portion 22 as observed in FIGS. 2 and 3 of the provided drawings. Cover portion 22 may be provided as a traditional mask cover that substantially covers a user's mouth and nose. In one embodiment, cover portion 22 may be provided as a cloth cover portion to cover the face. In another embodiment, cloth portion 22 may comprise of multiple layers of lightly woven, breathable fabric with an added nose wire. In yet another embodiment, cloth portion 22 may resemble that of an N95 mask. Furthermore, mask assembly 20 includes loops 24 operatively attached to the opposing lateral sides of cover portion 22. Loops 24 may be provided as elastic closed loop sections that enable a user to mount the cover portion 24 to their face. Loops 24 may then be mounted onto a user's ears to be securely mounted to the face.

Figure 4:
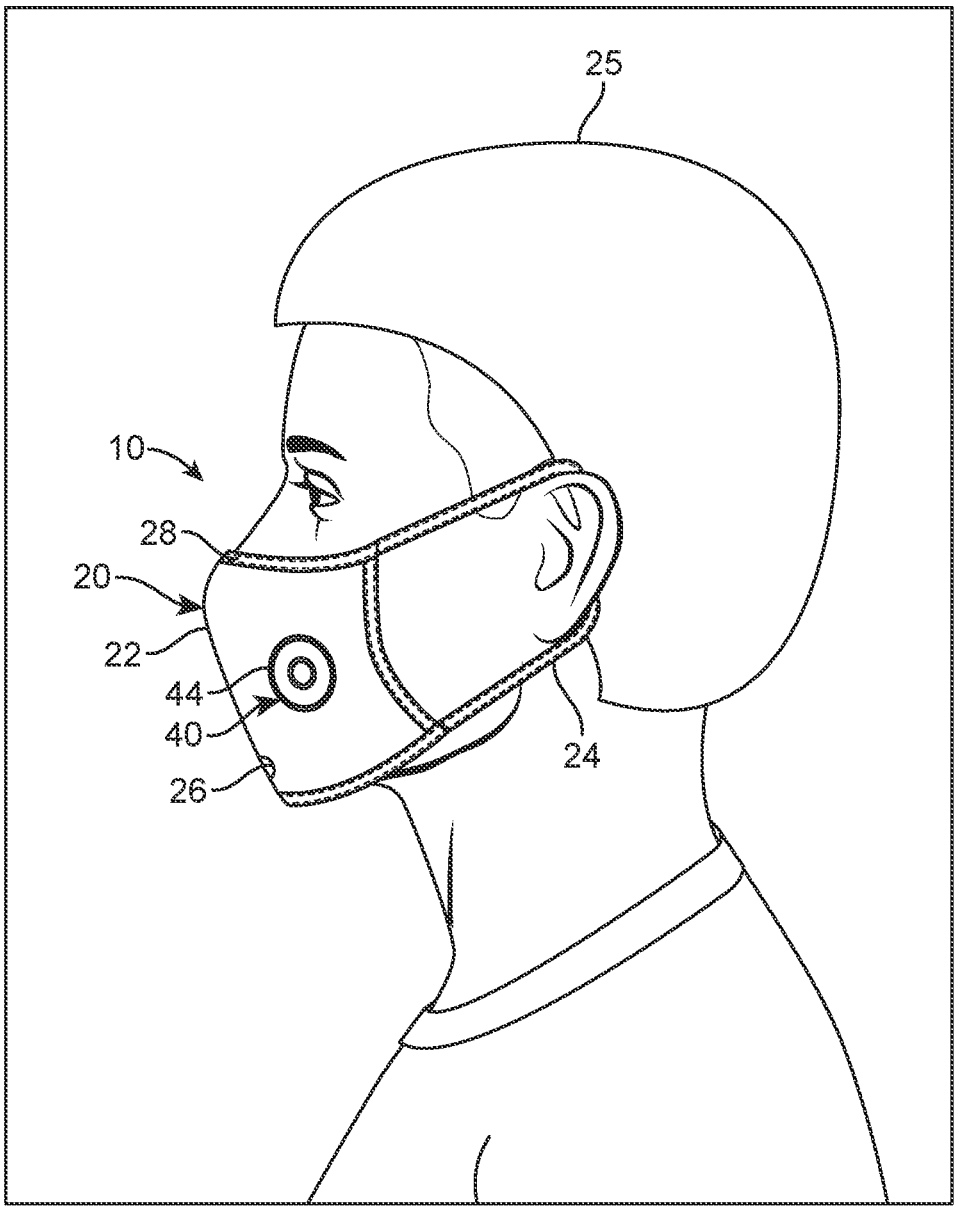
FIG. 4 is a representation of a side view of face mask with speaker module 10 having an operative hood attachment 25 mounted thereon in accordance with an embodiment of the present invention.

In another embodiment, mask assembly 20 further includes a hood attachment 25 as observed in FIG. 4 of the provided drawings. Hood attachment 25 may be provided as a cloth hood cover member that is operatively connected to loops 24 of mask assembly 20. In one implementation, hood attachment 25 may be either removably attached or permanently attached to loops 24. Hood attachment 25 may be attached to loops 24 via hooks, snap buttons, hook and loop fasteners, and the like. In the present invention, hood attachment 25 is substantially covers a user's head in order to protect a user from cold weather and other weather conditions. Furthermore, an aperture 26 is located on an exterior of cover portion 22. Aperture 26 extends through the cover portion to form an opening on cover portion 22. In the present embodiment, aperture 26 receives a straw in order to enable a user to deliver a liquid drink into their mouth.

Mask assembly 20 further includes an illumination component 28. In the present embodiment, illumination component 28 is positioned along a border on the exterior of cover portion 22. Illumination component 28 may be provided as LED light strips being positioned along the entire perimeter of the exterior of cover portion 22. It should be understood that other embodiments may feature illumination component 28 operatively mounted along other locations on cover portion 22. Furthermore, illumination component 28 may be actuated and edited via mobile device 50. In the present embodiment, illumination component 28 communicates with mobile device 50 via WiFi, Bluetooth, and other wireless communication means. A user may then set the color and parameters of illumination component 28 from their mobile device. Furthermore, the interior of mask portion 22 is lined with a tracking device 29. In the present embodiment, tracking device 29 may be provided as a GPS tracking device which is also in wireless communication with mobile device 50 to provide a user with a location of mask 10 in the event that it becomes lost or stolen.

Speaker assembly 40 includes a microphone 42 which may be observed in FIG. 3 of the provided drawings. In the present embodiment, microphone 42 is lined within the interior portion of mask portion 22. As a result, a user's speaking voice is received by microphone 42. Microphone 42 may be provided as either a wired or wireless microphone. Additionally, microphone 42 may be provided as a cardioid type or super/hyper cardioid type microphone. In yet another embodiment, microphone 42 may be provided as a shotgun microphone type. Speaker assembly 40 further includes speakers 44 operatively mounted to an exterior side of cover portion 22. In one embodiment speakers 44 is provided as two conical speakers positioned and exposed on the exterior of cover portion 22. Microphone 42 and speakers 44 are in operative communication with each other. In the present embodiment, microphone 42 receives a user's voice and is then amplified via an amplifier to be broadcasted from speakers 44. Speakers 44 may amplify the signal received up to 20 db. It should be understood that additional amplification boundaries may be set. This structure eliminates the muffle and dull speaking voice that is associated with a user wearing a mask. In yet another embodiment, the signal received by microphone 42 is also transmitted to mobile device 50 for recording or transmitting or streaming.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a face mask with speaker module, comprising:

a) a mask assembly including a cover portion and loops, wherein said cover portion includes an exterior side and an inner side, wherein said mask includes an aperture located on a mouth portion adapted to receive a straw, a tracking device lined within an inner side of said cover portion, wherein said mask assembly further includes an illumination component on said cover portion, wherein said illumination component is in wireless communication with a mobile device; and b) a speaker assembly including a microphone and speakers, wherein said microphone is line along the inner side of said cover portion, wherein said speakers are operatively mounted on the exterior side of said cover portion, said microphone and speakers being operatively connected to each other, said speakers adapted to amplify a user's speaking voice when wearing the face mask.

2. The system for a face mask with speaker module of claim 1 wherein said cover portion comprises a plurality of layers.

3. The system for a face mask with speaker module of claim 1 wherein said mask assembly further includes a hood attachment operatively mounted to the loops.

4. The system for a face mask with speaker module of claim 1 wherein said illumination component are LED lights.

5. The system for a face mask with speaker module of claim 1 wherein said illumination component is lined along a perimeter of said cover portion.

6. The system for a face mask with speaker module of claim 1 wherein said microphone is adjacent to said aperture on said inner side.

7. The system for a face mask with speaker module of claim 1 wherein said speakers are provided as two conical speakers.

8. The system for a face mask with speaker module of claim 1 wherein said speaker assembly amplifies audio up to 20 db.

9. A system for a face mask with speaker module, comprising:

a) a mobile device;

b) a mask assembly including a cover portion and loops, wherein said cover portion includes an exterior side and an inner side, wherein said cover portion comprises a plurality of layers, wherein said mask includes an aperture located on a mouth portion adapted to receive a straw, a tracking device lined within an inner side of said cover portion, wherein said mask assembly further includes an illumination component on said cover portion, wherein said illumination component are LED lights, wherein said illumination component is lined along a perimeter of said cover portion, wherein said illumination component is in wireless communication with the mobile device, wherein said mask assembly further includes a hood attachment operatively mounted to the loops; and c) a speaker assembly including a microphone and speakers, wherein said microphone is line along the inner side of said cover portion, wherein said microphone is adjacent to said aperture on said inner side, wherein said speakers are operatively mounted on the exterior side of said cover portion, wherein said speakers are provided as two conical speakers, wherein said speaker assembly amplifies audio up to 20 db, said microphone and speakers being operatively connected to each other, said speakers adapted to amplify a user's speaking voice when wearing the face mask.

10. A system for a face mask with speaker module, consisting of:

a) a mobile device;

b) a mask assembly including a cover portion and loops, wherein said cover portion includes an exterior side and an inner side, wherein said cover portion comprises a plurality of layers, wherein said mask includes an aperture located on a mouth portion adapted to receive a straw, a tracking device lined within an inner side of said cover portion, wherein said mask assembly further includes an illumination component on said cover portion, wherein said illumination component are LED lights, wherein said illumination component is lined along a perimeter of said cover portion, wherein said illumination component is in wireless communication with the mobile device, wherein said mask assembly further includes a hood attachment operatively mounted to the loops; and c) a speaker assembly including a microphone and speakers, wherein said microphone is line along the inner side of said cover portion, wherein said microphone is adjacent to said aperture on said inner side, wherein said microphone is a shotgun type microphone, wherein said speakers are operatively mounted on the exterior side of said cover portion, wherein said speakers are provided as two conical speakers, wherein said speaker assembly amplifies audio up to 20 db, said microphone and speakers being operatively connected to each other, said speakers adapted to amplify a user's speaking voice when wearing the face mask.

* * * * *